United States Patent [19]

Konishi et al.

[11] Patent Number: 4,654,911

[45] Date of Patent: Apr. 7, 1987

[54] PROCESS FOR DEGRADING BY HYDROLYSIS TEXTILES COMPRISING POLYESTER FIBER OR ACETATE FIBER

[75] Inventors: Keisuke Konishi, Fukui; Isao Tanaka, Kawanishi, both of Japan

[73] Assignees: Wako Technical Research Co., Ltd., Fukui; Mitsubishi Chemical Industries Limited, Tokyo, both of Japan

[21] Appl. No.: 722,159

[22] Filed: Apr. 11, 1985

[30] Foreign Application Priority Data

Apr. 11, 1984 [JP] Japan ..... 59-72279
Dec. 28, 1984 [JP] Japan ..... 59-279385

[51] Int. Cl.[4] ..... D06M 5/02
[52] U.S. Cl. ..... 8/158; 8/115.51
[58] Field of Search ..... 68/56; 8/158, 125, 127, 8/115.5, 115.51, 115.52, 115.53, 115.55, 115.56, 115.57, 115.58, 115.59

[56] References Cited

U.S. PATENT DOCUMENTS

| | | | |
|---|---|---|---|
| 4,263,008 | 4/1981 | Sando et al. | 8/125 |
| 4,332,585 | 6/1982 | Minemura et al. | 8/115.56 |
| 4,400,838 | 8/1983 | Steers et al. | 68/12 R X |

FOREIGN PATENT DOCUMENTS

| | | | |
|---|---|---|---|
| 876607 | 7/1971 | Canada | 8/125 |
| 38-9344 | 6/1963 | Japan | 8/115.5 |
| 52-141245 | 11/1977 | Japan . | |
| 53-45495 | 4/1978 | Japan | 8/115.5 |
| 53-61790 | 6/1978 | Japan | 8/115.5 |
| 54-73997 | 6/1979 | Japan | 8/158 |
| 56-144269 | 11/1981 | Japan | 8/115.5 |
| 57-5970 | 1/1982 | Japan | 8/115.5 |
| 57-16971 | 1/1982 | Japan | 8/115.5 |
| 57-154461 | 9/1982 | Japan | 8/115.5 |
| 57-154460 | 9/1982 | Japan | 8/115.5 |
| 58-120872 | 7/1983 | Japan | 8/115.5 |
| 58-186670 | 10/1983 | Japan | 8/115.5 |
| 608335 | 9/1948 | United Kingdom | 8/115.5 |

OTHER PUBLICATIONS

S. M. Gawish & G. Ambroise, "Alkaline Hydrolysis of Polyester Fabric," American Dyestuff Reporter, (Feb. 1986), 30–32.

*Primary Examiner*—Harvey C. Hornsby
*Assistant Examiner*—Frankie L. Stinson
*Attorney, Agent, or Firm*—Toren, McGeady and Goldberg

[57] ABSTRACT

This process carries out degradation of textile comprising polyester fiber and/or acetate fiber in the apparatus having an automatic titration device and a microcomputer, and the degradation is carried out in the substantially closed state in the apparatus, and the course of the degradation is monitored based on the decrease in the concentration of alkaline solution in the apparatus. According to the invention, the rate of degradation can be easily and accurately controlled.

11 Claims, 1 Drawing Figure

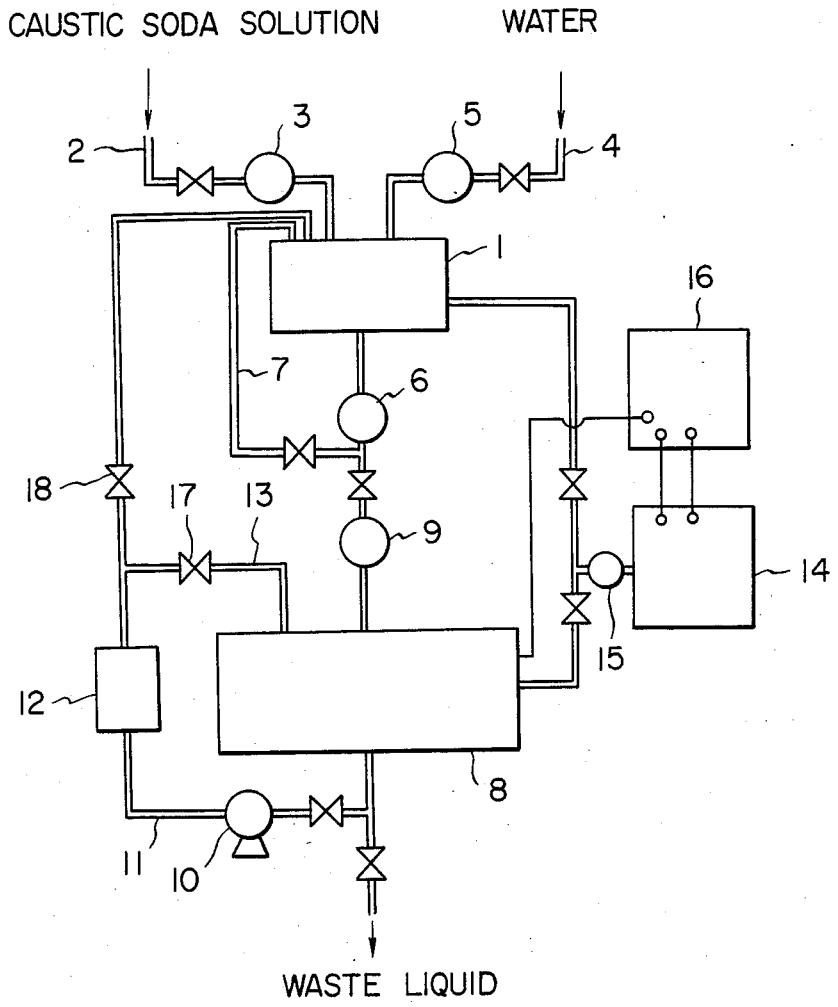
CAUSTIC SODA SOLUTION
WATER
2
3
5
4
1
16
7
6
18
17
13
9
14
15
12
8
11
10
WASTE LIQUID

PROCESS FOR DEGRADING BY HYDROLYSIS TEXTILES COMPRISING POLYESTER FIBER OR ACETATE FIBER

BACKGROUND OF THE INVENTION

This invention relates to a process for degrading of textiles comprizing polyester fiber and/or acetate fiber.

By degrading is meant to process these textiles with an aqueous solution containing alkaline substance so as to chemically decompose a part thereof and remove it from the textiles. In the degrading of textiles comprizing polyester fiber, a part of polyester is hydrolyzed into ethylene glycol and terephthalic acid and removed from textiles. In the degrading of the textiles comprizing acetate fiber, a part of acetyl group of cellulose acetate is hydrolyzed and removed.

Degrading of textiles comprizing polyester fiber has widely been practiced (refer to British Patent Specification No. 786153). On the other hand, degrading of textiles comprizing acetate fiber has not been practiced industrially as yet, but it is attracting interest as one means for processing the textiles. By degrading the textiles comprising polyester fiber, textiles can be obtained which have softness similar to silk, and reduced tendency for generating static electricity, and which are excellent in prevention of pilling, and in stainproofing property, etc. Furthermore, when degrading is applied on textiles comprizing acetate fiber, the surface of the acetate fiber is changed to cellulose, i.e., a fiber of double construction, having acetate in the interior, and cellulose in the surface, is obtained, and it is considered that the feeling thereof is improved.

The degree of improvement obtained by degradation depends on the rate of degradation, that is to say, the rate of decrease of weight of the textiles by degradation.

Problems on practicing the degrading industrially are that it is difficult to control the rate of degradation at high accuracy, and some times textiles are obtained to which excessive degradation have been proceeded, or to which the predetermined rate of degradation has not been attained. For example, in the degrading of textiles comprizing polyester fiber, a method is carried out in which several pieces of test cloths of known weight having the same quality as the textiles are attached to the textiles to be treated, and when the degradation seems almost to comes to its finishing point, the test cloths are taken out one by one, and by measuring the decrease of their weight, it is possible to determine whether or not the textiles under treatment reached to the predetermined rate of degradation. However, the degrading of textiles under treatment proceeds even while the test cloths were taken out and the weight were measured, so that it is difficult to control the rate of degradation with good accuracy by this method. In another method, previously drawing experimentally a diagram showing relations between the concentration of the "solution" (in the specification and Claim, it is referred to as "treating bath") containing basic substance used for degrading, degrading temperature, processing time and rate of degradation and by use of the diagram, the time reaching the desired rate of degradation can be estimated. However, with this method, again, it is not always possible to obtain textiles having desired rate of degradation, because strict control of concentration or temperature of the treating bath is difficult.

SUMMARY OF THE INVENTION

The object of the present invention is to provide a process for degrading textiles comprizing polyester and/or acetate fiber which can control the rate of degradation with high accuracy.

Another object of the present invention is to provide a process for degradation wherein textiles comprizing polyester fiber and/or acetate fiber is washed in a liquid-current type fiber processing apparatus (refer to U.S. Pat. No. 3,782,138), and successively degraded in the same apparatus with good accuracy.

Further object of the present invention is to provide a process for controlling it with high accuracy by means of a statistic method.

According to the present invention, in a process for degrading textiles wherein treating bath is made to come in contact with textiles comprizing polyester fiber and/or acetate fiber in a degrading apparatus so as to hydrolyze the polyester fiber or acetate fiber, the rate of degradation of the textiles can be controlled with high accuracy by determining the finish point of the degradation on the basis of steps comprising: determining weight of the textiles to be treated and volume and concentration of the treating bath in the apparatus before proceeding the hydrolysis substantially; raising the temperature of the treating bath up to the hydrolysis temperature; proceeding the hydrolysis in substantially closed state of the apparatus and during which measuring the concentration of the treating bath with the lapse the time; calculating the rate of degradation of the textiles based on said measured value, the initial weight of the textiles, and the initial volume and concentration of the treating bath; and determining the finish point of the degradation on the basis of the calculated rate of degradation.

BRIEF DESCRIPTION OF THE DRAWING

The single FIGURE in the drawing is a diagram illustrating a liquid-current type fiber processing apparatus suitable for carrying out the present invention.

DETAILED DESCRIPITION OF THE INVENTION

The textiles, object of the process for degradation according to the present invention, are those comprizing polyester fiber and/or acetate fiber. As for the textiles comprizing polyester are those made only of polyester fiber and those made of polyester fiber and other fibers such as cotton or nylon fiber which are not hydrolyzed under degrading condition of polyester fiber. Further, for textiles comprizing acetate, there are those made of acetate fiber alone, and those which are made of acetate fiber and other fibers such as polyester fiber. In general, so-called diacetate fiber is singly used, in many cases, for manufacturing textiles such as cloth lining, etc. On the other hand, so-called triacetate fiber is seldom used singly, but used for manufacturing textiles as a mixture with polyester fiber. Since the acetate fiber is hydrolyzed more easily under less severe condition than the polyester fiber, acetate fiber alone can substantially be hydrolyzed by degrading textiles comprizing both acetate and polyester fibers.

The hydrolysis of polyester fiber is usually carried out using caustic soda solution as the treating bath. The concentration of caustic soda in the treating bath is usually within a range from 20 to 150 g/l. The hydrolysis proceeds more quickly when the concentration of caustic soda is higher, so that the concentration of the caustic soda is preferably more than 50 g/l. The temperature of the hydrolysis is usually within a range from 80° to 100° C., but reaction can be effected outside of this temperature range, if desired.

The hydrolysis of the acetate fiber can be proceeded easily under less severe condition than that for polyester fiber. Hydrolysis of triacetate fiber is usually carried out using caustic soda solution having a concentration less than 40 g/l as the treating bath at 60° to 100° C. Preferably, concentration of the caustic soda for the treating bath is 2 to 20 g/l, and more preferably, 5 to 10 g/l.

The hydrolysis of diacetate fiber is usually carried out at 60° to 100° C. using sodium carbonate solution as the treating bath. The concentration of the sodium carbonate for the treating bath is usually less than 60 g/l, preferably 10 to 40 g/l. In a case where diacetate fiber is hydrolyzed using caustic soda solution, it is preferable to use caustic soda solution having a low concentration of less than 10 g/l more preferably less than 5 g/l.

The degradation of textiles according to the present invention is effected in such a way as accommodating the treating bath and textiles to be treated into a degrading apparatus, and causing the treating bath to circulate therein so as to prevent occurrence of local unevenness in concentration of treating bath. During the degradation, the apparatus is closed substantially so that the concentration of the treating bath will not be changed due to factors other than hydrolysis reaction. As for the apparatus of degradation, various types of fiber treating apparatus can be used, but it is preferable to use a liquid-current type textile treating apparatus having a heating device in external circulating passage of liquid in combination with an automatic alkali titration device incorporated with a microcomputer.

The single FIGURE illustrates a diagram of a liquid-current type textile treating apparatus suitable for practicing the present invention. In the drawing, the numeral 1 shows a reservoir of the treating bath, to which are supplied a concentrated solution of basic substance through a conduit 2 and a flow meter 3, and water through a conduit 4 and a flow meter 5, respectively. The treating bath in the reservoir 1 is ciculated through a pump 6 and a conduit 7, whereby solution of basic substance supplied to the reservoir 1 and water are mixed quickly to form a uniform treating bath. The numeral 8 shows a treating tank, to which the treating bath in the reservoir 1 is supplied through a flow meter 9. The treating bath in the treating tank 8 is ciculated through a pump 10, a conduit 11, a heat exchanger 12 and a conduit 13, so as to make uniform the treating bath in the treating tank 8. Numeral 14 shows an automatic titration device, a predetermined quantity of treating bath in the reservoir 1 or in the treating tank 8 is introduced through a pump 15 to the titration vessel, for titration, and the treating bath after the titration is discharged out from the titration vessel, such operations can be repeated automatically. A microcomputer 16 receives the measured values from the automatic titration device and processes them for example by means of the method of least-squares. The microcomputer 16 also controlls all operations of the trating apparatus including the automatic titration device 14.

In the process according to this invention, the rate of degradation {(At(%)}(t) minutes after the beginning of degradation is calculated by the following formula based on the initial weight (W Kg) of the textiles to be treated in the treating apparatus the initial volume {V(l)} and the concentration {C(g/l)} of the treating bath before beginning of the degradation; and the concentration of the treating bath at that time point {Ct(g/l)}. In a case where the textiles to be treated consist of polyester fiber and the treating bath is caustic soda solution:

The hydrolysis of the polyester fiber proceeds from the end of the polymer chain according to the following formulas:

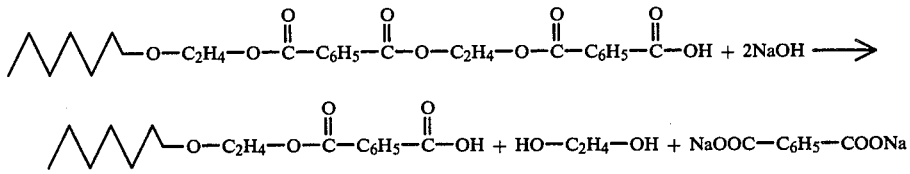

Accordingly, decrease of 2 mole (=80 g) of caustisic soda in the treating bath corresponds to decrease in weight 193 g of the textiles. Thus, if the degradation is carried out under substantially closed system, the decrease in concentration of the treating bath can be considered due exclusively to the above-mentioned reaction, so that $$(C - Ct)V \times \frac{193}{80} \times \frac{1}{W \times 10^3} + At \times \frac{1}{10^2}$$

therefore, $$At = \frac{(C - Ct)V}{W} \times \frac{193}{800}$$

$$= (C - Ct) \times \frac{V}{W} \times 0.24$$

In a case where the textiles to be treated consist of acetate fiber:

The hydrolysis of acetate fiber by caustic soda solution is a reaction wherein acetyl group of cellulose acetate turns into sodium acetate and is removed off, and hydroxyl group is reproduced.

$$\sim\sim C_6H_7O_2(OAc)_3 + 3NaOH \rightarrow$$
$$\sim\sim C_6H_7O_2(OH)_3 + 3NaOAC$$

Accordingly, since consumption of 1 mol (=40 g) of caustic soda corresponds to the weight decrease 44 g of the textiles.

$$At = (C - Ct)\frac{V}{W} \times 0.105$$

When the treating bath is sodium carbonate solution:

$$At = (C - Ct)\frac{V}{W} \times 0.0792$$

In this invention, the treating bath in the apparatus is analyzed with the lapse of time usually at an interval of 2 to 4 minutes to measure the concentration throughout the degrading process, and the rate of degradation is calculated from the above formulas. The analysis is preferably carried out using an automatic titration device incorporated with microcomputer. With such a device, it is possible to excecute repeatedly and automatically a series of analyzing operations including steps of: taking a predetermined quantity of the treating bath from the degrading apparatus into the titration apparatus; titrating the treating bath in the titration apparatus so as to measure the concentration; discharging the treating bath which has finished the titration out of the titration apparatus; and calculating the rate of degradation from the measured value.

In the case where the calculated rate of degradation coincides with the aimed rate of degradation or comes within a previously determined allowable range, the degradation is suspended by separating the treating bath from the textiles under treatment. Usually, the treating bath is discharged from the degradation tank, then warm water is supplied to the tank to wash and clean the textiles which have finished degradation. The treating bath discharged from the degradation tank is adjusted of its alkali concentration, and thereafter, it can be used as the treating bath for the next degradation. Thus, by repeating the recovery and the reuse, a hydrolyzed product accumulates in the treating bath, but degradation can be carried out smoothly even such a treating bath is used.

In one of the preferred example of this invention, the degradation is carried out at substantially constant temperature using a treating bath containing excessive amount of caustic soda, for example, 5 to 15 times stoichiometrically necessary for obteining textile of aimed rate of degradation. Under such conditions, the rate of degradation of the polyester fiber increases linearly proportional to the time. Accordingly, by measuring the concentration of the treating bath with the lapse of time during such degrading process, and by processing these measured values thus obtained by statistic method such as the method of least-squares or the like, it is possible to obtain accurate concentration of treating bath by eliminating measurement errors. Furthermore, with such a statistic method, since the concentration of treating bath at any time point in future can be estimated, it is possible to estimate the time at which the aimed rate of degradation is attained based on said estimated concentration. Such a statistic processing of the measured value can be effected very easily by microcomputer. One mode which is favorable for the case where such a statistic method is used, is a method in which the rate of degradation is calculated based on the estimated concentration of treating bath in future, for example, at the next measurement, and the degradation is stopped at a time point where the value is coincident substantially with the aimed rate of degradation. When the concentration of the treating bath is measured by titration, it requires 2 to 5 minutes for one measurement, so that the degradation of the textiles is proceeded further at the time point where the result of measurement is obtained. When the degradation proceeds slowly, the degradation can be stopped at the time when the rate of degradation calculated from the measured value coincides substantially with the aimed rate of degradation, or when the rate of degradation exceeds firstly over the aimed rate of degradation. However, when the degradation proceeds speedly it is preferable to estimate the rate of degradation in future from the measued value, and to determine the finish point of degradation on the bases of the estimated value. It is to be added, that the degrading reaction proceeds further for a certain defree even during the operations of separating textiles under treatment from the treating bath to interrupt the degradation, and washing the separated textiles to remove the treating bath adhered to the textiles. Therefore, it is not necessary that the time point of terminating the degradation reaction is coincident exactly with the finishing point which was estimated from the measured value, and the terminating time point can be determined in consideration of the allowable error of the rate of degradation and the reaction quantity in said after treatment.

In the degradation of acetate fiber, the rate of degradation increases linearly with time at initial stage of the degradation, but soon the increasing speed of the rate of degradation tends decrease gradually. Accordingly, the method of least-squares can be apprried when the aimed rate of degradation is sufficiently small with respect to the theoretically posible maximum rate of degradation, for example, less than $\frac{1}{3}$ of the theoretical maximum rate of degradation.

In the case wherein the present invention is practiced with an apparatus where water is used for charging the textiles to be degraded in the triating apparatus, or where the textiles to be degraded are previously washed with water and are processed by means of the present invention while the textiles are still in wet state, the treating bath to be fed to the degrading apparatus is diluted by water in the apparatus. Accordingly, in such a case, the degradation is commenced after the quantity and concentration of the treating bath in the apparatus at the beginning of degradation have been determined as described in the following. The treating bath is supplied to the degrading apparatus accommodating textiles in wet state, then the dilution of treating bath with water in the apparatus is accelerates by moving the treating bath therein. Assuming that the quantity of treating bath supplied to the apparatus is V(l), and the concentration is $C_1$(g/l), and the concentration of the treating bath when the dilution proceeds and local unevenness of the concentration of the treating bath is removed is C(g/l), then the volume V(l) of the treating bath in the apparatus can be calculated from the following formula:

$$V=(C_1/C)\times V_1$$

According to the present invention, the degrading of textiles can be effected while monitaring the progress of reaction incessantly, so that the rate of degradation can be controlled accurately.

The present invention will now be described more detail by referring to examples, but the invention is not limited thereto.

EXAMPLE 1

20 rolls of textile (weight per roll is 5.0 Kg) made of 75 denier hard twisted yarns of polyester fiber was put into 2000 l of caustic soda solution (concentration 50 g/l). The caustic soda solution was heated to 95° C., and the degrading reaction was carried out at this temperature. The concentration of the caustic soda solution was measured with the lapse of time throughout the reaction; and when the concentration of the caustic soda solution reached 45.8 g/l after 45 minutes, the textile under treatment was taken out of the caustic soda solution, washed with water, and dried. The rate of degradation of the textile under treatment was 19.5%, which coincides with the rate of degradation of 20% calculated from the decrease in the concentration of the caustic soda solution.

EXAMPLE 2

20 rolls (weight per roll 8.3 Kg) of a textile made of polyester fiber and nylon fiber (60% of polyester fiber, 40% of nylon fiber) was put into 2000 l of caustic soda solution (concentration 40 g/l). The caustic soda solution was heated to 90° C., and the degrading reaction was carried out at this temperature. Throughout the reaction, the concentration of the caustic soda solution was measured with the lapse of time, and when the concentration of the caustic soda solution lowered to 36.9 g/l after 60 minutes, the trextile under treatment was taken out of the caustic soda solution, washed with water, and dried. The rate of degradation of the textiles was 15% based on the polyester fiber, which coincides with the rate of degradation of 14.9% calculated from the decrease in the concentration of the caustic soda solution.

EXAMPLE 3

A textile made of polyester yarn was degraded in a liquid-current type degrading apparatus shown in the FIGURE. 15.50 Kg of textile was charged into the tank 8 by means of water stream, then, excess of water was discharged leaving the textile in the tank 8. Next, 200.0 l of caustic soda solution (concentration 81.8 g/l) was supplied at room temperature to the tank 8 from the caustic soda reservoir 1. The caustic soda solution in the tank 8 was caused to circulate for about 5 minutes through the conduit 11, heat exchanger 12 and conduit 13 by operating the pump 10. When the concentration of caustic soda solution in the tank 8 was measured three times repeatedly by an automatic titration device 14, each of measured values was nearly the same, and the average value of the caustic soda concentration in three measurements was determined to be 73.1 g/l. Accordingly, the volume of caustic soda solution in the tank 8 was 224 l.

While contining circulation of the caustic soda solution by the pump 10, steam is introduced into the heat exchanger 12 to heat the caustic soda solution up to 90° C., and degradation was carried out so as to obtain an aimed rate of degradation of 25% while maintaining said temperature of 90° C. The concentration of the caustic soda solution was periodically measured by the automatic titration device 14, and the results obtained were shown in Table. During the degradation, the measured values were processed by the method of least-squares and the concentration of caustic soda solution for the next time was estimated successively using a microcomputer 16. The concentration of 65.5 g/l was estimated after 59 minute 04 second from begining of the measurement, and it was the first time that the estimated concentration lowered than 65.7 g/l corresponding to the rate of degradation of 25%. Thus, by closing the valve 17 at this time point and opening the valve 18, caustic soda solution in the tank 8 was recovered to the reservoir 1. Successively the valve 17 was opened and the valve 18 was closed, so as to introduce water into the tank 8 to wash and clean the textile. The rate of degradation of the test cloth attached to the textile was 25.4%, which coincides with the calculated valve using above described means.

In this experiment, the automatic titration device 14 was so operated that the next titration was commenced immediately after a series of titration steps, including introduction of a predetermined quantity of sample to the titration vessel and discharge of treating bath from the titration vessel, had been finished. The measured value was processed by the method of least-squares so as to estimate the titration value of the next time when the time required from the sampling of the present time to the next sampling is equal to the time required from the preceding sampling to the present sampling, and the rate of degradation was calculated on the basis of this estimated value.

TABLE

| Passage time from beginning of the measurement (minute) | measured value (g/l) |
|---|---|
| 0 | 72.9 |
| 2.54 | 73.2 |
| 5.48 | 72.4 |
| 8.39 | 73.3 |
| 11.32 | 72.6 |
| 14.33 | 72.3 |
| 17.30 | 71.5 |
| 20.19 | 71.5 |
| 23.09 | 70.5 |
| 25.58 | 70.2 |
| 28.47 | 69.4 |
| 31.33 | 69.2 |
| 34.19 | 68.4 |
| 37.03 | 68.9 |
| 39.51 | 68.2 |
| 42.37 | 67.7 |
| 45.22 | 67.3 |
| 48.05 | 66.7 |
| 50.50 | 66.4 |
| 53.34 | 66.6 |
| 56.19 | 65.9 |
| (59.04) | (65.5) ← Estimated value |

What is claimed is:

1. In a process for hydrolytic degrading of textiles composed of polyester or acetate fibers wherein the textiles are treated in a chamber with a treating bath containing a stoichiometric excess of a basic substance, the improvement which comprises the steps of: determining the weight of the textiles and the volume and concentration of the treating bath in the chamber, starting the hydrolysis by raising the temperature of the bath to hydrolysis temperature, carrying out the hydrolysis in the chamber while keeping the chamber substantially closed and the treating bath substantially uniform throughout the chamber, measuring the concentration of the treating bath during the hydrolysis at designated intervals, calculating the rate of degradation from the changes in concentration of the treating bath, the weight of the textiles, and the initial quantity and concentration of the treating bath, and determining the finish point of the degradation based on the calculated rate of degradation.

2. The process of claim 1 wherein the textile is polyester fiber.

3. The process of claim 1 wherein the textile is polyester fiber and cotton.

4. A process for the hydrolytic degradation of textiles of polyester or acetate fiber comprising the steps of: charging a known quantity of a treatipg bath containing a basic substance at a known concentration into a chamber which accommodates a known weight, based on the dry state, of the textiles in the wet state, the amount of the basic substance in the treating bath being in stoichiometric excess to the amount necessary to attain the desired rate of degradation of the textiles, diluting the bath with water and measuring the concentration after the dilution, carrying out the hydrolysis by raising the temperature of the bath while keeping the chamber substantially closed and the treating bath substantially uniform in concentration throughout the chamber, measuring the concentration of the treating bath at designated intervals during the hydrolysis, measuring the volume and the initial concentration of the treating bath charged in the chamber and the concentration of the treating bath after the dilution step, and interrupting the hydrolysis when the calculated rate of degradation has substantially coincided with the predetermined rate of degradation.

5. The process of claim 4 wherein the dilution of the treating bath with water is carried out under conditions such that the hydrolysis of the textiles being treated is not accelerated.

6. A process for the hydrolytic degradation of textiles of polyester or acetate fiber comprising the steps of: charging a known quantity of a treating bath containing a basic substance at a known concentration into a chamber which accommodates a known weight, based on the dry state, of the textiles in the wet state, the amount of the basic substance in the treating bath being in stoichiometric excess to the amount necessary to attain the desired rate of degradation of the textiles; mixing the treating bath in the chamber to obtain a uniform concentration and under conditions so that the hydrolysis does not substantially proceed; raising the temperature of the treating bath up to hydrolysis temperature; carrying out the hydrolysis while maintaining the hydrolysis temperature substantially constant, maintaining the chamber substantially closed and the concentration of the treating bath substantially uniform throughout the chamber during the hydrolysis; measuring the concentration of the treating bath at designated intervals during the hydrolysis and calculating from these values a corrected value of measurement for the last measured value using the method of least squares; calculating the rate of degradation of the textiles on the basis of the corrected measured value, the weight of the textile in the apparatus and the quantity and concentration of the treating bath charged into the apparatus and the concentration of the treating bath measured before raising the temperature to hydrolysis temperature; and interrupting the hydrolysis when the calculated rate of degradation is the same as the predetermined rate of degradation.

7. The process of claim 6 wherein the textile is polyester fiber.

8. The process of claim 6 wherein the textile is polyester fiber and cotton.

9. A process for the hydrolytic degradation of textiles of polyester or acetate fiber comprising the steps of: charging a known quantity of a treating bath containing a basic substance at a known concentration into a chamber which accommodates a known weight, based on the dry state, of the textiles in the wet state, the amount of the basic substance in the treating bath being in stoichiometric excess to the amount necessary to attain the desired rate of degradation of the textiles; mixing the treating bath in the chamber to obtain a uniform concentration and under conditions so that the hydrolysis does not substantially proceed; raising the temperature of the treating bath up to hydrolysis temperature; carrying out the hydrolysis while maintaining the hydrolysis temperature substantially constant, maintaining the chamber substantially closed and the concentration of the treating bath substantially uniform throughout the chamber during the hydrolysis; measuring the concentration of the treating bath at designated intervals during the hydrolysis; estimating from these measured values, a future concentration value using the method least squares; calculating the rate of degradation of the textile at the specific future point in time on the basis of said estimated values, the weight of textile in the chamber, the quantity and concentration of the treating bath charged in the apparatus, and the value of the concentration of the treating bath measured prior to raising the temperature of the treating bath to the hydrolysis; and determining the time for interrupting the hydrolysis by comparing the estimated rate of degradation with the desired rate of degradation.

10. The process of claim 9 wherein the textile is polyester fiber.

11. The process of claim 9 wherein the textile is polyester fiber and cotton.

* * * * *

UNITED STATES PATENT AND TRADEMARK OFFICE

CERTIFICATE OF CORRECTION

PATENT NO. : 4,654,911

DATED : April 7, 1987

INVENTOR(S) : Keisuke Konishi and Isao Tanaka

It is certified that error appears in the above-identified patent and that said Letters Patent is hereby corrected as shown below:

On the Title Page:

In the heading of the Patent, it should read:

-- [54] PROCESS FOR DEGRADING BY HYDROLYSIS TEXTILES COMPRIZING POLYESTER FIBER OR ACETATE FIBER

Signed and Sealed this

Twenty-fifth Day of August, 1987

*Attest:*

DONALD J. QUIGG

*Attesting Officer*

*Commissioner of Patents and Trademarks*